United States Patent [19]

Adkins et al.

[11] Patent Number: 4,967,450

[45] Date of Patent: Nov. 6, 1990

[54] NOVELTY CLIP APPARATUS

[76] Inventors: Donna J. Adkins; Stephen G. Campbell, both of 3960 A1A S. Unit 706, St. Augustine, Fla. 32084

[21] Appl. No.: 381,386

[22] Filed: Jul. 18, 1989

[51] Int. Cl.[5] ..... A44B 21/00

[52] U.S. Cl. ..... 24/3 J; 24/458

[58] Field of Search ..... 24/355, 507, 707.7, 24/458, 3 H, 3 R, 3 J, 3 L, 11 R, 11 CC, 11 CT, 11 HC, 11 P; 224/252, 269, 194; 206/37, 38

[56] References Cited

U.S. PATENT DOCUMENTS

| | | | |
|---|---|---|---|
| 1,330,208 | 2/1920 | Mertz | 24/3 R |
| 1,933,958 | 11/1933 | Balut | 24/507 X |
| 2,059,582 | 11/1936 | Hurewitz | 24/507 |
| 2,586,740 | 2/1952 | Swanson | 224/252 |
| 2,729,913 | 1/1956 | Holwerda | 224/252 X |
| 2,935,186 | 5/1960 | Clerk | 224/252 X |
| 4,083,481 | 4/1978 | Selinko | 224/252 |
| 4,194,657 | 3/1980 | Thor | 224/252 |
| 4,667,374 | 5/1987 | Bianchi | 224/252 X |

FOREIGN PATENT DOCUMENTS

| | | | |
|---|---|---|---|
| 525303 | 5/1956 | Canada | 24/507 |
| 219405 | 12/1983 | Japan | 24/35 |

*Primary Examiner*—James R. Brittain

*Attorney, Agent, or Firm*—Leon Gilden

[57] ABSTRACT

A novelty clip apparatus is set forth for effecting a snap-on securement to overlie notebooks and the like by individuals. The apparatus includes spring-biased clip including an upper and lower pivotally mounted jaw arrangement with the lower jaw including a matrix of upwardly extending pins to cooperate with an interior surface of the upper jaw. A series of extension members are securable to the upper jaw to provide an overlying and extended upper jaw arrangement and encourage use of the clip by an aesthetically enhanced extension member. The extension member may be formed of a variety of elongate configurations and includes an underlying blind channel for receiving the upper jaw of the clip fixedly and securedly thereto. The extension member further includes an interior storage compartment with a removable forward cap securable in an aligned relationship with the exterior wall of the extension member.

1 Claim, 5 Drawing Sheets

NOVELTY CLIP APPARATUS

BACKGROUND OF THE INVENTION

1. Field of the Invention

The field of invention relates to securement clips, and more particularly pertains to a new and improved novelty clip apparatus wherein the same effects storage and aesthetic enhancement of the clip and its association with articles to be secured thereby.

2. Description of the Prior Art

Various clips in various configurations have been provided by the prior art to enhance the aesthetic appearance thereof. The prior art, however, has heretofore failed to set forth a clip arrangement as set forth by the instant invention wherein the same provides for an effective clip with an overlying extension jaw, wherein the extension jaw member includes a storage compartment therein as well as a clip receiving channel. Examples of prior art may be found in U.S. Design Pat. No. 232,987 to Matas; U.S. Design Pat. No. 175,981 to Rubeck; U.S. Design Pat. No. 155,983 to Freiler; U.S. Design Pat. No. 186,933 to Sapiro; and U.S. Design Pat. No. 135,753 to Graeter. The design patents are illustrative of various configurations of clips for ornamental purpose, but the prior art fails to provide the organization as provided by the instant invention of a securement clip with an overlying extension defining a length at least four times that of the upper jaw about which the extension member is secured.

As such, it may be appreciated that there continues to be a need for a new and improved novelty clip apparatus which addresses both the problems of ease of use and effectiveness in construction, and in this respect, the present invention substantially fulfills this need.

SUMMARY OF THE INVENTION

In view of the foregoing disadvantages inherent in the known types of clip apparatus now present in the prior art, the present invention provides a novelty clip apparatus wherein the same utilizes a replaceably mounted extension member secured to an upper jaw of the clip to provide both an elongate upper jaw portion as well as a storage chamber for the clip arrangement. As such, the general purpose of the present invention, which will be described subsequently in greater detail, is to provide a new and improved novelty clip apparatus which has all the advantages of the prior art clip apparatus and none of the disadvantages.

To attain this, the present invention comprises a spring-biased clip including relatively mounted upper and lower jaws pivotally mounted relative to one another. The lower jaw includes a "U" shaped matrix of upwardly projecting pins for enhanced engagement with the underlying surface of the upper jaw. The upper jaw is securable to an extension member of a ratio at least four times the length of that of the lower jaw and is secured to a rear underlying surface of the extension member. The extension member may be formed in a variety of shapes, but may further include a blind channel provided with an inwardly directed projection to restrict the entrance of the blind channel to enhance securement of the upper jaw when directed therewithin. The extension member may further be provided with an interior storage compartment with a removable forward cap of a configuration consistent with the exterior configuration of the extension member. The cap receives a reduced dimensional extension directed outwardly of the chamber to effect alignment of an exterior wall of the cap with that of the extension member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved novelty clip apparatus which has all the advantages of the prior art clip apparatus and none of the disadvantages.

It is another object of the present invention to provide a new and improved novelty clip apparatus which may be easily and efficiently manufactured and marketed.

It is a further object of the present invention to provide a new and improved novelty clip apparatus which is of a durable and reliable construction.

An even further object of the present invention is to provide a new and improved novelty clip apparatus which is susceptible of a low cost of manufacture with regard to both materials and labor, and which accordingly is then susceptible of low prices of sale to the consuming public, thereby making such novelty clip apparatus economically available to the buying public.

Still yet another object of the present invention is to provide a new and improved novelty clip apparatus which provides in the apparatuses and methods of the prior art some of the advantages thereof, while simultaneously overcoming some of the disadvantages normally associated therewith.

Still another object of the present invention is to provide a new and improved novelty clip apparatus wherein the same provides for enhanced overlapping engagement of an upper jaw as well as a storage compartment within the extension member securable to an upper jaw of a spring-biased clip.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood objects other than those set forth above will become apparent when consideration is given to the following detailed description thereof. Such description makes reference to the annexed drawings wherein:

FIG. 17 is a top orthographic view illustrative of the clip secured to the third embodiment extension member.

FIG. 18 is a top orthographic view of the first embodiment extension member and the clip associated therewith.

FIG. 19 is a top orthographic view of the second embodiment extension member and the clip associated therewith.

DESCRIPTION OF THE PREFERRED EMBODIMENT

Figure 1:
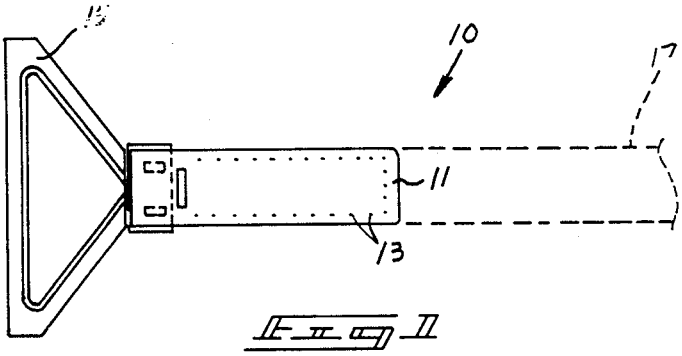
FIG. 1 is a top orthographic view of a clip utilized by the instant invention.
Figure 2:
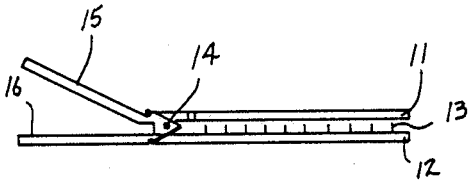
FIG. 2 is an orthographic view taken in elevation of the clip as set forth in FIG. 1.

With reference now to the drawings, and in particular to FIGS. 1 to 19 thereof, a new and improved novelty clip apparatus embodying the principles and concepts of the present invention and generally designated by the reference numerals 10, 17, 19, 20, 21, 26, and 28 will be described.

Figure 3:
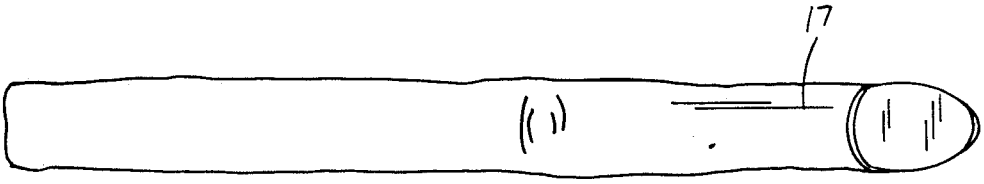
FIG. 3 is a top orthographic view of a first embodiment extension member.
Figure 4:
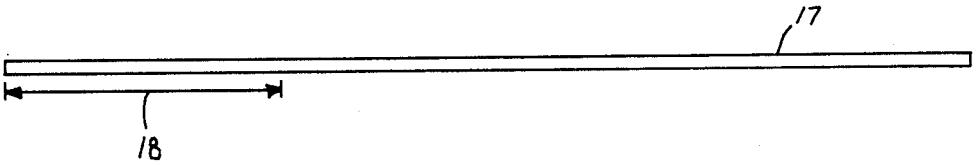
FIG. 4 is an orthographic view taken in elevation of the extension member of FIG. 3.
Figure 5:
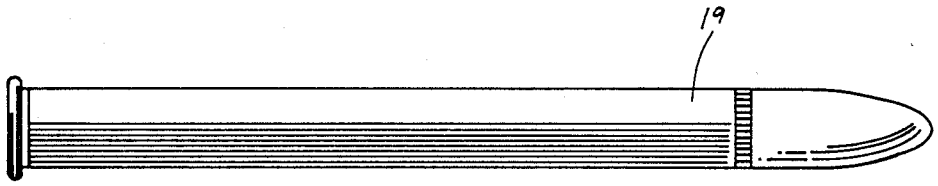
FIG. 5 is a top orthographic view of a second embodiment extension member.
Figure 6:
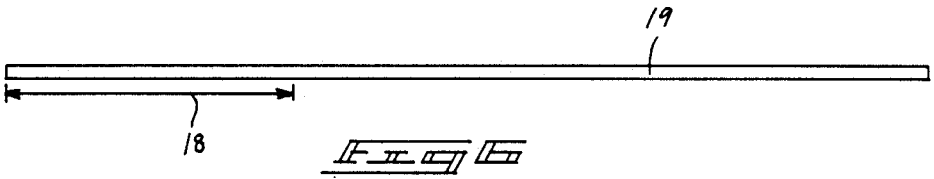
FIG. 6 is an orthographic view taken in elevation of the extension member of FIG. 5.
Figure 7:
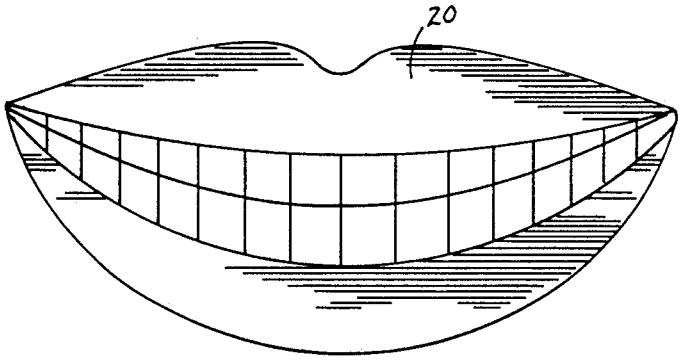
FIG. 7 is a top orthographic view of a third embodiment extension member utilized by the instant invention.
Figure 8:
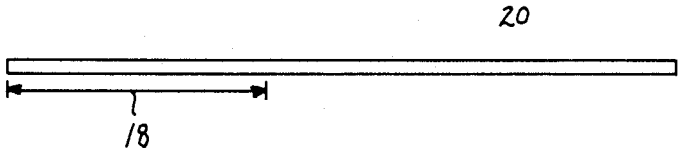
FIG. 8 is an orthographic view taken in elevation of the extension member of FIG. 7.
Figure 9:
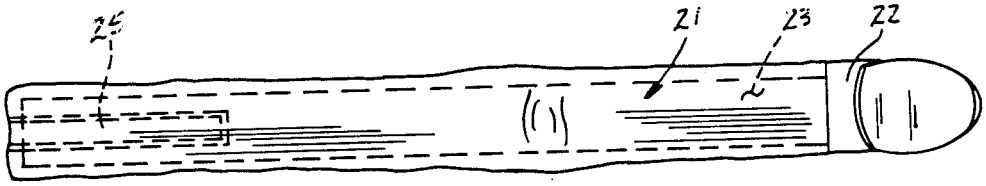
FIG. 9 is a top orthographic view of a storage extension member.
Figure 10:
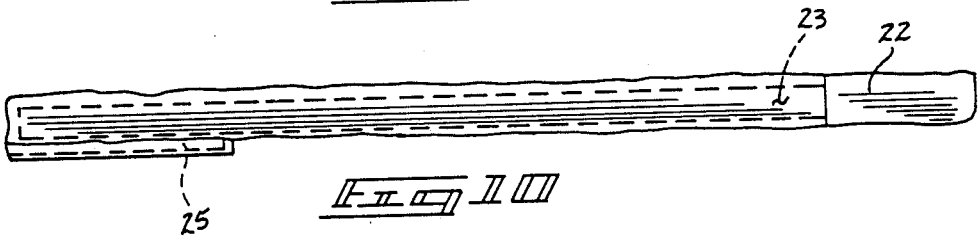
FIG. 10 is an orthographic view taken in elevation of the extension member of FIG. 9.
Figure 11:
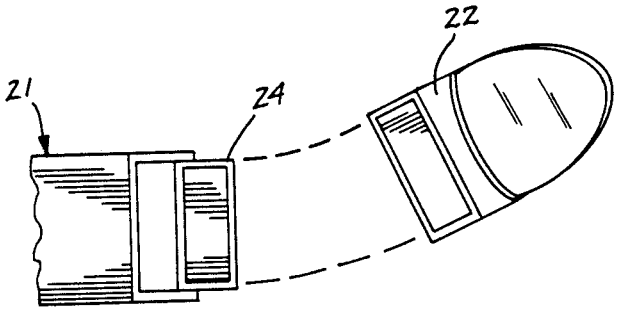
FIG. 11 is a top orthographic view, somewhat exploded, of the cap portion is association with the extension member.
Figure 12:
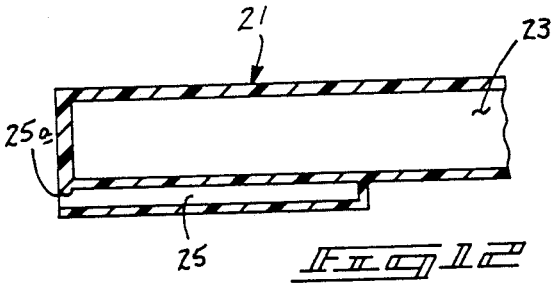
FIG. 12 is a rear orthographic cross-sectional view of the extension member of FIG. 10 somewhat expanded.
Figure 13:
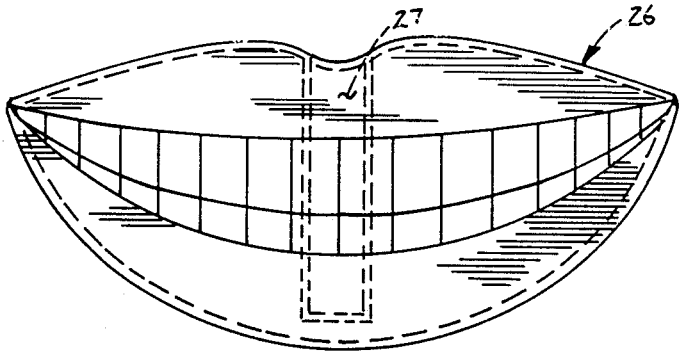
FIG. 13 is a top orthographic view of a further embodiment of a storage extension member.
Figure 14:
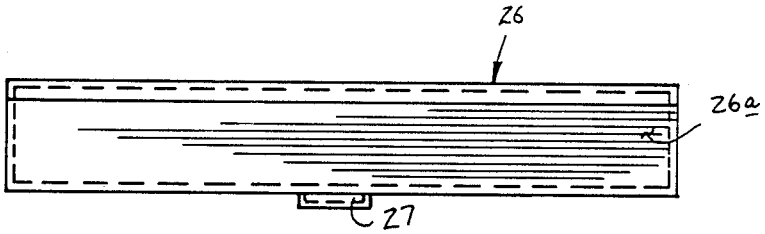
FIG. 14 is a frontal orthographic view taken in elevation of the storage extension member of FIG. 13.
Figure 15:
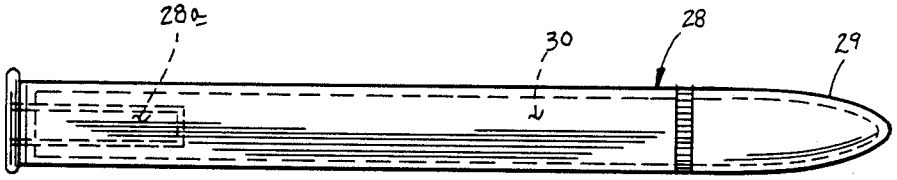
FIG. 15 is a top orthographic view of a yet further storage extension member.
Figure 16:
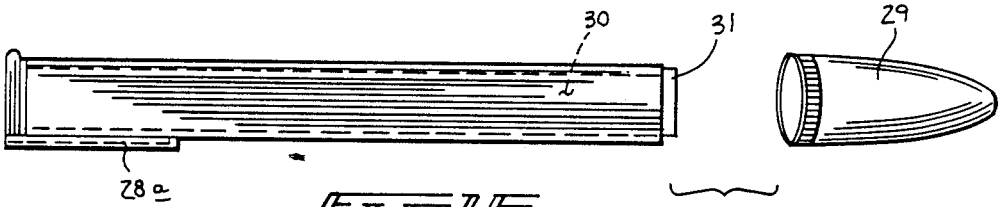
FIG. 16 is an orthographic view taken in elevation of the extension member of FIG. 15 with the cap removed therefrom.
Figures 11, 11B, 11C:
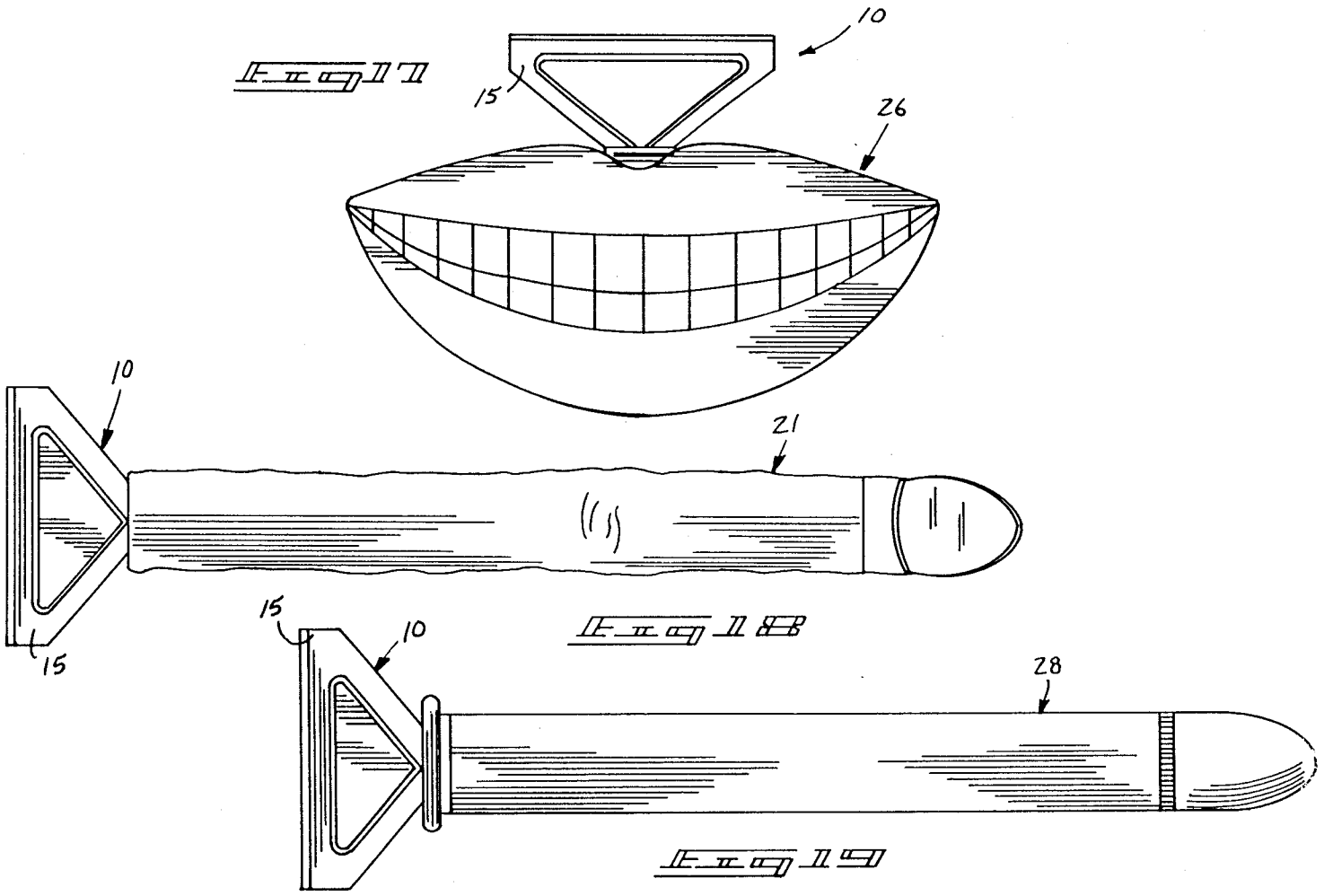

More specifically, the novelty clip apparatus of the instant invention essentially comprises a spring-clip 10 formed with an upper jaw 11 overlying a lower jaw 12 with the upper jaw pivotally mounted relative to the lower jaw through a spring-biased pivot hinge 14 positioned between the upper and lower jaws and an upper handle 15 and a lower handle 16 respectively and integrally associated with the upper and lower jaws. The lower jaw includes a "U" shaped matrix of pin detents 13 oriented orthogonally relative to the lower jaw to enhance gripping therebetween. The upper and lower jaws 12 each define upper and lower planar parallel surfaces with interior surfaces of the respective upper and lower jaws cooperating relative to one another for relative engagement therebetween. A first extension member 17, as illustrated in FIG. 3, of a novel configuration is adhesively securable to an upper surface of the upper jaw 11 about a rear portion of the bottom surface of the first extension member 17. It is contemplated that the length of an extension member 17 and the like be of a ratio at least four times that of the length of the upper jaw 11 to enhance grasping of the apparatus when secured about a clipboard and the like. FIG. 5 is illustrative of a second extension member 19 of a further configuration with a third extension member 20 in FIG. 7 depicting yet a further extension member that may be selectively utilized in association with the spring-clip 10. FIGS. 9, 13, and 15 illustrate further extension member utilizing storage compartments therein. The fourth extension member 21 is formed with a removable forward tubular cap 22. The fourth extension member 21 includes an elongate interior chamber 23 formed coextensively within the fourth extension member and includes an axially aligned engagement shank 24 of a reduced cross-sectional configuration to that of the exterior wall of the fourth extension member to receive the cap 32 thereon and maintain alignment of the exterior wall of a cap with that of the fourth extension member 21. A further blind channel 25 is formed originating at a rearward end of the fourth extension member remote from that of the tubular cap and the blind channel defines an interior configuration complementary to that of the upper jaw 11 of the spring clip 10. An engagement projection **25*a* extends coextensively with a rear end wall of the fourth extension member to enhance frictional engagement of the blind chamber 25 with the upper jaw 11. Reference to FIGS. 13 and 15 illustrate a respective fifth extension member 26 and a sixth extension member 28 respectively wherein each includes a respective blind channel 27 and 28*a* respectively of a configuration equal to that of the blind channel 25 as set forth in FIG. 12 for example. Each includes a forwardly oriented removable cap 28 defined as a clip securement chamber portion 29, as illustrated in FIG. 15 for example, cooperative with a reduced shank 31, as illustrated in FIG. 16, to provide access to the interior chamber 30 of the embodiment of FIGS. 15 and 16. The embodiment of FIGS. 13 and 14 includes an interior storage chamber 26*a* with the forward portion of the extension member 26 removable in a manner comparable to that as set forth in FIGS. 11 and 16**.

FIGS. 17, 18 and 19 respectively illustrate the association of the spring-clip 10 and the respective extension and storage portions 26, 21, and 28 respectively. The storage chambers thusly provide for selective storage of pencils, paper clips and the like as conveniently and readily available to an individual in use of the instant invention.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationship for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A clip arrangement comprising, in combination, a clip member including an upper planar jaw pivotally mounted relative to a lower planar jaw, and an extension member selectively securable to the upper planar jaw and of a predetermined length greater than said upper planar jaw, the extension member including a securement portion on a bottom rearwardmost surface of the extension member for securement to the upper planar jaw, and wherein the lower planar jaw includes a "U" shaped matrix of pin projections each orthogonally and integrally secured to an upper surface of the lower planar jaw to enhance securement between the upper and lower planar jaws, and wherein the predetermined length is at least four times a length defined by the upper planar jaw, and wherein the extension member includes a cap frictionally securable to a shank of a reduced cross-sectional configuration relative to an extension member cross-sectional configuration, wherein the tubular cap defines an exterior surface coextensive with an exterior surface of a main body of the extension member, and wherein the main body of the extension member defines an interior chamber coextensive with the main body of the extension member, and wherein the securement portion includes a blind channel originating at a rear end wall of the extension member remote from the tubular cap and wherein the blind chamber defines an interior configuration complementary to that of an exterior configuration defined by the upper planar jaw, and wherein the blind chamber further includes an engagement projection directed interiorly of the blind chamber and aligned with the rear end wall of the extension member to engage the upper planar jaw when the upper planar jaw is secured within the blind channel.

* * * * *